US005532059A

United States Patent [19]

Lee

[11] Patent Number: 5,532,059

[45] **Date of Patent: *Jul. 2, 1996**

[54] POLY(P-PHENYLENE TEREPHTHALAMIDE) PULP

[75] Inventor: Kiu-Seung Lee, Richmond, Va.

[73] Assignee: E. I. Du Pont de Nemours and Company, Wilmington, Del.

[ * ] Notice: The term of this patent shall not extend beyond the expiration date of Pat. No. 5,416,164.

[21] Appl. No.: 315,180

[22] Filed: Sep. 29, 1994

[51] Int. Cl.[6] ..... C08L 77/06; D02G 3/00

[52] U.S. Cl. ..... 428/359; 525/182

[58] Field of Search ..... 525/182; 428/359

[56] References Cited

U.S. PATENT DOCUMENTS

| | | | |
|---|---|---|---|
| 3,036,988 | 5/1962 | Knospe et al. | 525/182 |
| 3,211,807 | 10/1965 | Gillies et al. | 525/182 |
| 3,287,441 | 11/1966 | Magat | 525/182 |
| 3,564,075 | 2/1971 | Hermann et al. | 525/182 |
| 4,511,623 | 4/1985 | Yoon et al. | 428/359 |
| 4,959,453 | 9/1990 | Sweeny | 528/336 |
| 5,028,372 | 7/1991 | Brierre | 264/148 |
| 5,073,440 | 12/1991 | Lee | 428/224 |
| 5,135,687 | 8/1992 | Lee | 264/28 |

FOREIGN PATENT DOCUMENTS

| | | |
|---|---|---|
| 0381172 | 1/1990 | European Pat. Off. . |
| 396020 | 4/1990 | European Pat. Off. . |

*Primary Examiner*—Ana L. Carrillo

[57] ABSTRACT

A fibrous pulp of a combination of poly(p-phenylene terephthalamide) and poly(vinyl pyrrolidone) is provided, along with a process for making it. The process involves conducting a poly(p-phenylene terephthalamide polymerization reaction in the presence of poly(vinyl pyrrolidone) and the product is an improved pulp with increased fibrils and no fiber stalks.

6 Claims, 4 Drawing Sheets

POLY(P-PHENYLENE TEREPHTHALAMIDE) PULP

BACKGROUND OF THE INVENTION

1. Field of the Invention

The present invention relates to manufacture of an improved form of fibrous pulp utilizing poly(p-phenylene terephthalamide) (PPD-T). Pulps have traditionally been made from spun aramid fibers which are mechanically refined and take the form of a fiber backbone or stalk with fibrils extending therefrom. Pulp of the present invention is not made from spun fibers and provides bundles of pulp particles which have a high proportion of fibrils and a very low proportion of stalks.

2. Description of the Prior Art

U.S. Pat. Nos. 5,073,440 and 5,135,687 issued on the applications of Kiu-Seung Lee, teach continuous fibers comprising a para-aramid and poly(vinyl pyrrolidone) and a method for spinning such fibers.

European Patent Application Nos. 381,172 and 396,020, published Sep. 8, 1990 and Nov. 7, 1990, disclose homogeneous alloys of certain aromatic polyamides and poly(vinyl pyrrolidone) and continuous fibers and films made from such alloys.

U.S. Pat. No. 4,511,623, issued on the application of H. S. Yoon, teaches the preparation of short aramid fibers by subjecting a solution of the polymerizing aramid to high mechanical shearing.

U.S. Pat. No. 5,028,372, issued on the application of Brierre et al. teaches the manufacture of pulp by subjecting anisotropic solutions of polymerizing para-aramid to shear forces for the purpose of orienting polymer chains as they grow.

SUMMARY OF THE INVENTION

This invention provides a process for making a fibrous pulp of a combination of PPD-T and poly(vinyl pyrrolidone) (PVP) by the steps of: establishing an agitated PPD-T polymerization system comprising a solvent for polymerization components and also comprising PVP having a viscosity average molecular weight of at least 100,000 in a concentration of at least 5 weight percent, preferably at least 10 weight percent, based on the weight of the polymer to be made; adding stoichiometric quantities of PPD-T polymerization components to make reactive contact in the polymerization system; continuing reactive contact of the polymerization components for a time sufficient to achieve an anisotropic polymerization system, permit complete reaction of the PPD-T polymerization components, and combine the PPD-T with the PVP; and separating the combination of PPD-T and PVP from the polymerization system.

The fibrous pulp made by the process of this invention includes a heterogeneous combination of poly(p-phenylene terephthalamide) and at least 5 weight percent poly(vinyl pyrrolidone) having a viscosity average molecular weight greater than 100,000 wherein individual pulp particles are stalk-free and have a length of 0.5 to 10 millimeters, a diameter of 0.1 to 50 micrometers, and an aspect ratio of greater than 100.

BRIEF DESCRIPTION OF THE DRAWINGS

FIG. 1 shows a product which is not adequately fibrous and FIGS. 2–5 show the fibrous pulp products of this invention.

DETAILED DESCRIPTION OF THE INVENTION

The fibrous pulp of this invention is made from a combination of two polymeric components. One component is poly(p-phenylene terephthalamide) (PPD-T) and the other component is poly(vinyl pyrrolidone) (PVP).

By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of small amounts of other aromatic diamines and other aromatic diacid chlorides, such as, for example, 2,6-naphthaloyl chloride or chloro- or dichloroterephthaloyl chloride. Preparation of PPD-T is described in U.S. Pat. Nos. 4,308,374 and 4,698,414.

PVP is the additive polymer in pulp fibers of this invention. By PVP is meant the polymer which results from linear polymerization of monomer units of N-vinyl-2-pyrrolidone and includes small amounts of comonomers which may be present in concentrations below those which do not interfere with the interaction of the PVP with the PPD-T.

The combination of polymeric components is accomplished by polymerizing the PPD-T in the presence of the PVP. The preferred medium for polymerizing PPD-T is a completely anhydrous solvent system of N-methyl pyrrolidone (NMP) having a salt, such as calcium chloride, dissolved therein to enhance solubility of the PPD-T, once formed. Other salts which can be used to increase the solubility of the PPD-T include quaternary ammonium chloride, lithium chloride, magnesium chloride, strontium chloride, and the like, which are soluble in NMP. For practice of the present invention, the solvent system, also, has PVP dissolved therein during the progress of the PPD-T polymerization reaction.

As a practical matter, it is preferred to dissolve the PVP in the NMP before adding any of the aforementioned salt. It has been discovered that the salt, while it may increase solubility of PPD-T in the polymerization system, depresses initial solubility of PVP in NMP.

PVP, present during polymerization of PPD-T in NMP such that an anisotropic system is established, is believed to cause the polymerizing PPD-T to form oriented or aligned domains of polymer molecules which ultimately result in pulp fiber formation. In the pulp fiber formation, due to the anisotropic nature of the system, it is believed that the PPD-T and the PVP are combined in such a way that domains of the PPD-T are surrounded by PVP to yield pulp particles of a heterogeneous combination of the two materials.

Figure 6:
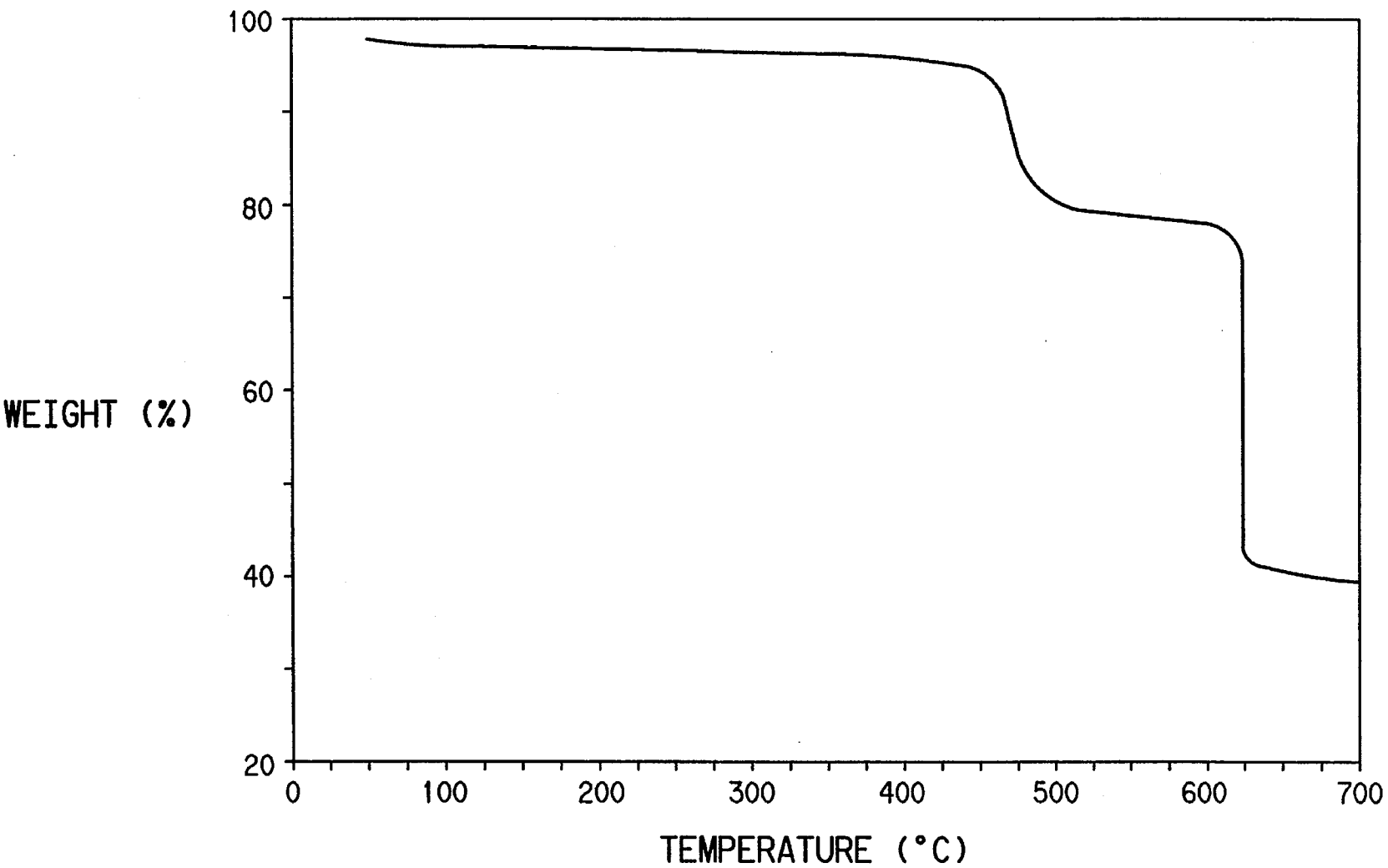
FIG. 6 is a thermogravimetric analysis graph of the heterogeneous combination of PPD-T and PVP of this invention.

Referring to FIG. 6, there is shown a graph which results from thermogravimetric analysis of a material of this invention. Thermogravimetric analysis (TGA) involves heating a sample of material and recording residual weight of the sample as a function of the temperature. Weight changes occur at temperatures of volatilization of sample components. The material shown in TGA in FIG. 6 is a combination of PPD-T and 20 weight percent PVP, as prepared in accordance with this invention. The PPD-T had an inherent viscosity of 5.1 and the PVP had a viscosity average molecular weight of 630,000. It is noted that the curve of FIG. 6 exhibits two steep falls. The first fall commences at about 440° C. and represents volatilization of the PVP component. PVP is rapidly volatilized to a temperature of about 500° C. and, then, more slowly to a temperature of about 600° C. The second fall commences at about 600° C. and represents volatilization of the PPD-T component. The two, separate, steep, falls in the TGA curve provide clear evidence of the existence of physically separate components in the combination of this invention.

Figure 7:
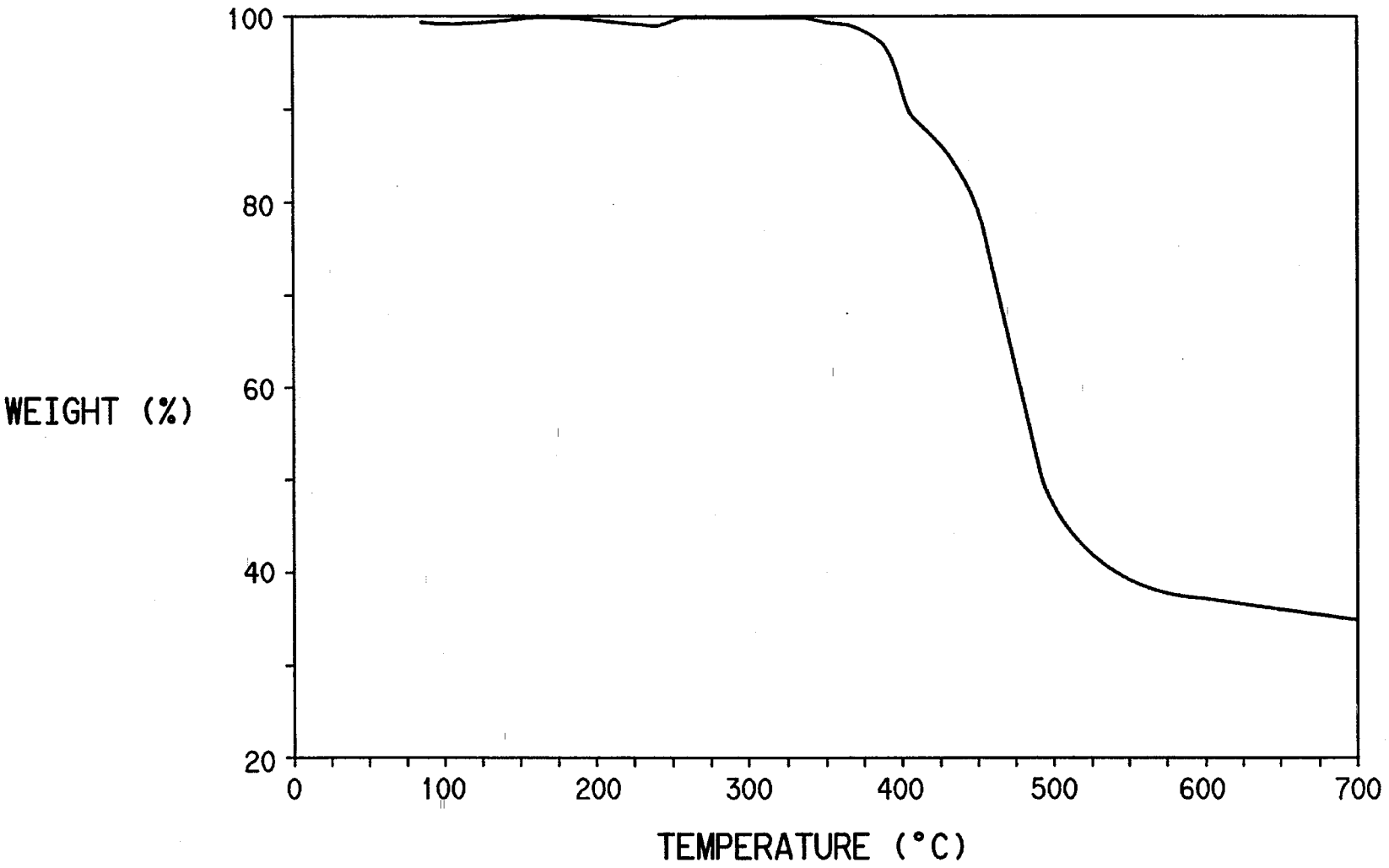
FIG. 7 is a thermogravimetric analysis graph of a homogeneous alloy of an aromatic polyamide and PVP of the prior art.

Referring now to FIG. 7, there is shown a graph which results from TGA of a material disclosed in European Patent Application No. 381,172, which is 2,2'-bis[4-(4'-aminophenoxy)phenyl]propane terephthalamide (BAPP-T), disclosed to be homogeneously combined and alloyed with 20 weight percent PVP. BAPP-T, polymerized in the presence of PVP, results in an isotropic—not an anisotropic—system of components and appears to be, as stated in the aforementioned European Patent Application, a closely joined, homogeneous, alloy of component materials. It is noted that the curve of FIG. 7 exhibits a single steep fall, which commences at about 380° C. and proceeds through about 600° C., representing volatilization of the homogeneous alloy of BAPP-T and PVP. The single steep fall in the TGA curve provides clear evidence of the existence of homogeneous, bound, combination of materials in the prior art.

It has been determined that PVP having a viscosity average molecular weight of greater than about 100,000 and a concentration of at least 5 percent, preferably at least 10 percent, based on weight of the PPD-T, is necessary for practice of this invention. PVP having a viscosity average molecular weight of less than about 100,000 does not appear to provide adequate support for orientation of growing PPD-T polymer chains and, as a consequence, does not yield an effective result. PVP having viscosity average molecular weights of greater than about 2,000,000 are only difficultly soluble and may not yield solutions which are useful for operation at the required PVP concentrations. PVP having viscosity average molecular weights of more than 100,000 have been found useful for practice of the present invention. For purposes of practicing this invention, the appropriate PVP molecular weight environment can be obtained by a combination of PVP materials of different molecular weights. For example, PVP of 50,000 viscosity average molecular weight can be combined with PVP of 500,000 viscosity average molecular weight in amounts such that the overall viscosity average molecular weight of PVP in the polymerization system is greater than 100,000, as calculated on a molar basis.

The PVP must be present in an amount which is at least 5 percent of the weight of the PPD-T to be formed and a greater amount can be used if desired. Less than 5 percent PVP doesn't appear to provide enough PVP to achieve the desired result. The upper limit for PVP concentration is a matter of practicality. It has been determined that the size and quality of the fibrous pulp particles of PPD-T is increased as the PVP concentration is increased up to a concentration of about 20, to as much as 30, percent of the weight of the PPD-T to be formed. Concentrations of PVP greater than 30 percent do not appear to hinder results but, neither do they seem to appreciably improve the size or yield of the pulp product.

Polymerization of the PPD-T involves addition, to the polymerization system, of stoichiometric amounts of diamine and diacid chloride. As a general rule, the diamine component is dissolved in the polymerization system and the diacid chloride is added thereto, either all at once, or in more than one portion.

Addition of the PPD-T polymerization components is conducted under conditions of agitation and that agitation is generally continued to an anisotropic solution and through the PPD-T polymerization reaction until the polymerization reaction is substantially complete. The PPD-T and the polymerization system become extremely viscous during the polymerization reaction and it is preferred to continue the agitation for the purpose of maintaining contact between reacting components. It is not necessary, however, to provide agitation or shear forces to the polymerization system; and, in fact, agitation is not necessary once the reacting components have been put into reactive contact.

While agitation is useful for practice of the present invention, it should be understood that the length and quality of the pulp product is dependent upon the concentration and molecular weight of PVP which is present in the polymerizing system. The kernel of this invention and what is considered to be of patentable significance is the discovery that the pulp is the heterogeneous product of a PPD-T polymerization conducted in the presence of PVP under the conditions prescribed herein, using an anisotropic polymerization system.

At completion of the PPD-T polymerization, the fibrous PPD-T pulp is separated from the polymerization system by breaking up the polymerization system solids in water through several washes and filtering or centrifuging the pulp from the liquid.

The resulting, fibrous, pulp is PPD-T polymer with 5 to 30, preferably 10–25, percent PVP, based on weight of the PPD-T. The concentration of PVP in the pulp is, to some extent, a function of the PVP concentration in the polymerization system. For example, PPD-T with about 10 percent PVP will result from a polymerization system having a PVP concentration of 10 percent. However, it appears that, in equilibrium conditions, about 20 percent is the maximum PVP concentration in the pulp, no matter how high the PVP concentration in the polymerization system. It is believed that PVP is somehow combined with the PPD-T up to a concentration of about 20 percent and, beyond that concentration, any excess the PVP is washed from the pulp during the pulp separation step. It is, of course, possible to make pulp with more than 20 percent PVP by polymerizing PPD-T in a solution of PVP with a concentration greater than 20 percent and then taking care to wash the pulp incompletely. As stated, the PVP present in the pulp in excess of about 20 percent will not be a combined part of the PPD-T/PVP material; but neither will it significantly adversely affect the properties of the pulp.

The pulp particles of this invention have an average length of from about 0.5 to about 10 mm, or perhaps slightly longer, a diameter of only about 0.1 to 50 micrometers, and an aspect ratio of greater than 100. By "aspect ratio" is meant the ratio of individual pulp particle length to diameter.

Because they are not refined from spun fibers, these pulp particles are free from fiber stalks.

TEST METHODS

Pulp Shape Factor

Figure 1:
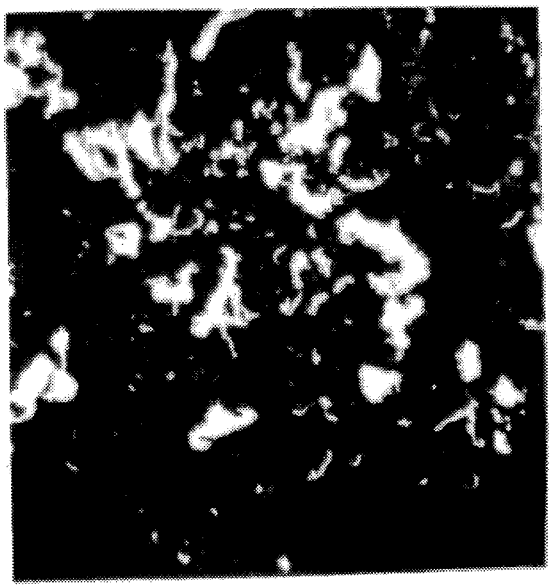
FIGS. 1–5 are photographs of aramid polymerization products made under a variety of conditions including the conditions of the process of this invention.

While the quality of pulp particles may be somewhat difficult to describe, assistance can be obtained by reference to the Figures which show fibrous pulp particles of various quality at about 40× magnification:

Shape Grade 1 is depicted in FIG. 1 and represents the PPD-T crumb particles which are made using no PVP additive. Particles of Shape Grade 1 exhibit no fibrous character.

Figure 2:
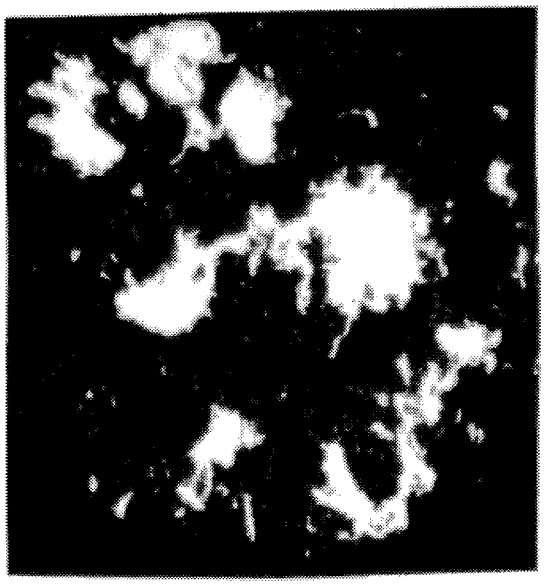

Shape Grade 2 is depicted in FIG. 2 and represents the lowest form of fibrous pulp in this invention. Pulp of Shape Grade 2 is mostly fibrous and includes fibers up to about 2 millimeters in length.

Figure 3:
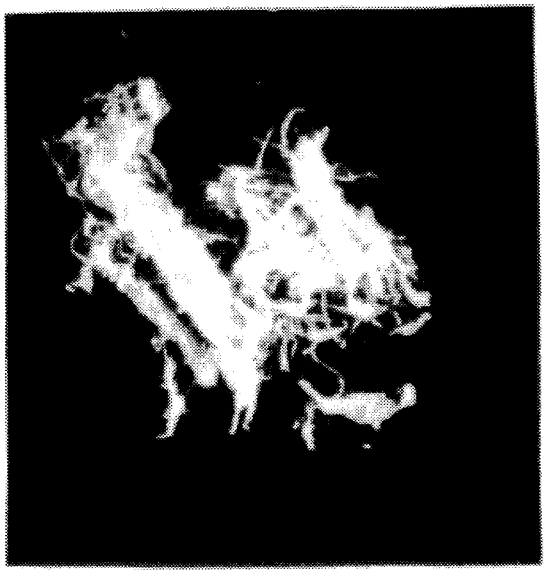

Shape Grade 3 is depicted in FIG. 3 and represents fibrous pulp of an average grade. Pulp of Shape Grade 3 is fibrous and includes fibers up to about 3 millimeters in length.

Figure 4:
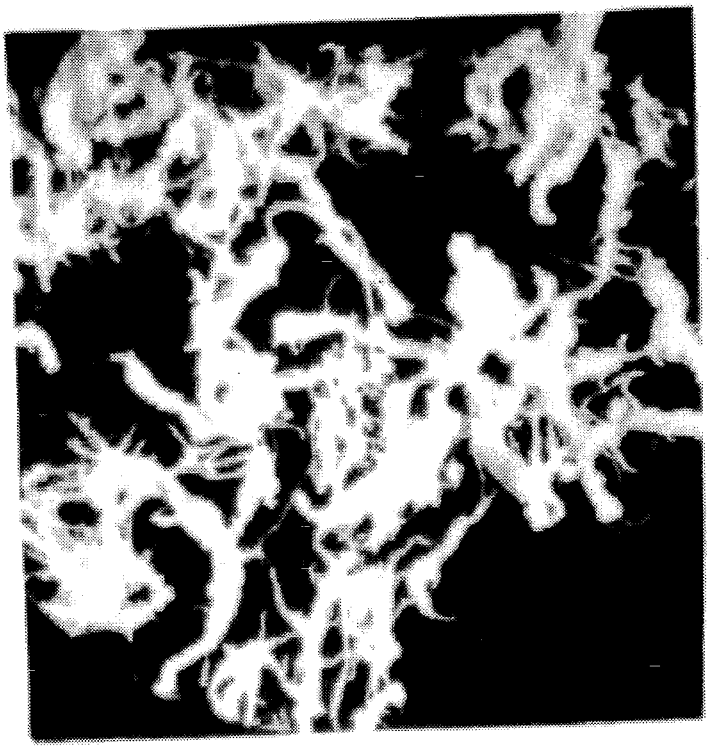
Figure 5:
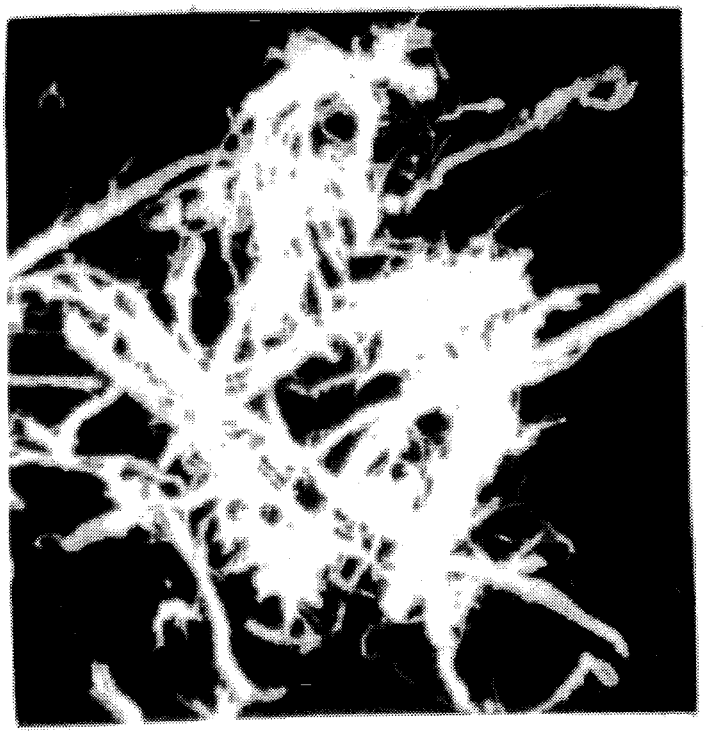

Shape Grade 4 is depicted in FIG. 4 and represents pulp of good grade with fibers up to about 5 millimeters in length.

Shape Grade 5 is depicted in Fib. 5 and represents pulp of excellent grade with fibers up to about 7 millimeters and more in length.

Inherent Viscosity of PPD-T

Inherent Viscosity (IV) is defined by the equation:

$$IV=\ln(\eta_{rel})/c$$

where c is the concentration (0.5 gram of polymer in 100 ml of solvent) of the PPD-T in the polymer solution and $\eta_{rel}$ (relative viscosity) is the ratio between the flow times of the polymer solution and the solvent as measured at 30° C. in a capillary viscometer. The inherent viscosity values reported and specified herein are determined using concentrated sulfuric acid (96% $H_2SO_4$).

Viscosity Average Molecular Weight of PVP

Molecular weight of PVP, as used herein, is the viscosity average molecular weight as described in Kirk-Othmer, Encyclopedia of Chemical Technology, Third Edition, Volume 23, John Wiley & Sons, at page 968 under "Vinyl Polymers (N-Vinyl)". The viscosity average molecular weight, $M_v$, is related to intrinsic viscosity as follows:

$$M_v=\left(\frac{(\eta_{int})}{1.4\times10^{-4}}\right)^{1/0.7}$$

Intrinsic viscosity is determined by the well known method of measuring relative viscosities at several polymer concentrations and extrapolating to the viscosity at zero concentration (the intrinsic viscosity). Suppliers of PVP often identify the PVP product by a "K number" which is associated with the intrinsic viscosity by the following equation:

$$\eta_{int}=2.303(0.001K+0.000075K^2).$$

Viscosity average molecular weights for PVP can be calculated from "K values" using the equations set out above.

Thermogravimetric Analysis

TGA for the tests herein were conducted in accordance with the procedures set out in ASTM D 3850-84 using nitrogen.

EXAMPLES

Example 1

In a reaction vessel, an agitated, PPD-T polymerization system was established by dissolving 12.5 parts calcium chloride in 147.5 parts N-methyl pyrrolidone (NMP). The calcium chloride and the NMP were carefully and competely dried. 9.329 parts p-phenylene diamine were dissolved in the polymerization system and 24.2 parts of a solution of 15 parts of PVP in 85 parts of NMP were added to the polymerization system. The PVP had a molecular weight of 630,000 and was supplied by International Specialty Products in Wayne, N.J., U.S.A. With agitation maintained, the system was cooled to about 5° C., and 17.670 parts of terephthaloyl chloride were added to the polymerization system.

In a very short time, the system became opalescent to indicate anisotropy; and in about 2 minutes, the system reached a maximum viscosity as a very tough gel. The agitation was maintained and the gel was broken into highly fibrous particles during continued agitation over 15 additional minutes.

The resulting fibrous pulp was washed several times with water in a blender to remove the NMP, the $CaCl_2$, and the HCl generated during the polymerization. The polymer had an inherent viscosity of 5.7 and the pulp had a Shape Grade of 5 with individual fibers having a length of about 5–7 mm.

Comparison Example 1C

A polymerization identical with Example 1, above, was conducted except that the PVP which was used had a molecular weight of only 38,000. The resulting product was a PPD-T crumb with no fibrous characteristics. The PPD-T had an inherent viscosity of 5.8.

Example 2–6

In these examples, the same polymerization procedure was used as was used in Example 1, except that the PVP was a combination of two materials having different molecular weights. PVP was used having 38,000 and 630,000 molecular weights to generate PVP's with a variety of equivalent molecular weights; and a total of 15 percent PVP was used in each example. Table 1, below, contains details on the PVP as well as data on the resulting fibrous pulp.

TABLE 1

| Example | PVP (g)* | | M.W. | Inherent | Shape Factor |
|---|---|---|---|---|---|
| Number | 38M | 630M | Equiv. | Viscosity | of Polymer |
| 1C | 24.16 | 0 | 38,000 | 5.8 | 1 |
| 2 | 19.63 | 4.53 | 149,000 | 3.5 | 2 |
| 3 | 15.85 | 8.30 | 241,000 | 4.9 | 2 |
| 4 | 12.08 | 12.08 | 334,000 | 3.5 | 4 |
| 5 | 8.30 | 15.85 | 426,000 | 3.8 | 5 |
| 6 | 4.53 | 19.63 | 519,000 | 3.6 | 5 |
| 1 | 0 | 24.16 | 630,000 | 5.7 | 5 |

*PVP Solution Concentration in NMP: 15% (w/w), Dried by distillation.

Examples 7–11

In these examples, the same polymerization procedure was used as in Example 1, except that the PVP was added in several different amounts. The PVP of these examples had a molecular weight of about 630,000. Table 2, below, contains details of the examples including data on the resulting pulp products.

TABLE 2

| Example Number | PVP* (g) | Percent PVP | Inherent Viscosity | Fiber Length |
|---|---|---|---|---|
| 7 | 7.20 | 5.0 | 3.03 | 0.5 mm |
| 8 | 15.21 | 10.0 | 4.08 | 2 mm |
| 9 | 24.16 | 15.0 | 5.10 | 5 mm |
| 10 | 34.23 | 20.0 | 4.40 | 7 mm |
| 11 | 45.64 | 25** | 4.00 | 6 mm |

*PVP Solution Concentration in NMP: 15% (w/w). Dried by distillation.
**Pulp was washed to retain excess PVP in the pulp.

Example 12

This example demonstrates that continued agitation is not necessary for practice of the present invention. As in Example 1, above, a PPD-T polymerization system was established by dissolving 12.5 parts calcium chloride in 147.5 parts N-methyl pyrrolidone (NMP), with agitation. 9.329 parts p-phenylene diamine were dissolved in the polymerization system and 24.2 parts of a solution of 15 parts of PVP in 85 parts of NMP were added to the polymerization system. The PVP had a molecular weight of 630,000. With agitation maintained, the system was cooled to about 5° C., and 17.670 parts of terephthaloyl chloride were added to the polymerization system.

In a very short time, the system became opalescent to indicate anisotropy; and the agitation was stopped. The system was permitted to stand overnight.

The resulting fibrous pulp was washed several times with water in a blender to remove the NMP, the $CaCl_2$, and the HCl generated during the polymerization. The polymer had an inherent viscosity of 3.84 and the pulp had a Shape Grade of 3 with individual fibers having a length of about 2 mm.

What is claimed is:

1. A process for making a fibrous pulp of poly(p-phenylene terephthalamide) and poly(vinyl pyrrolidone) comprising the steps of:

(a) combining, with agitation, to establish an agitated polymerization system, a solvent for polymerization components and poly(vinyl pyrrolidone) having a viscosity average molecular weight of at least 100,000 to yield a concentration, in the polymerization system, of 5 to 30 weight percent, based on the weight of the polymer to be made;

(b) adding stoichiometric quantities of poly(p-phenylene terephthalamide) polymerization components to make reactive contact in the polymerization system;

(c) continuing reactive contact of the polymerization components for a time sufficient to (i) achieve an anisotropic polymerization system, (ii) permit complete reaction of the poly(p-phenylene terephthalamide) polymerization components, and (iii) combine the poly(p-phenylene terephthalamide) with the poly(vinyl pyrrolidone) to yield a solid polymerization system;

(d) breaking up the solid polymerization system; and (e) separating a fibrous pulp of the combination of poly(p-phenylene terephthalamide) and poly(vinyl pyrrolidone) from the polymerization system.

2. The process of claim 1 wherein agitation of the polymerization system is continued through step (c).

3. The process of claim 1 wherein the polymerization components are p-phenylene diamine and terephthaloyl chloride.

4. The process of claim 1 wherein the poly(vinyl pyrrolidone) is a single polymer with a viscosity average molecular weight of at least 100,000.

5. The process of claim 1 wherein the poly(vinyl pyrrolidone) is a combination of polymers with a viscosity average molecular weight of at least 100,000.

6. Fibrous pulp of poly(p-phenylene terephthalamide) comprising a combination of 70 to 95 weight percent poly(p-phenylene terephthalamide) and 5 to 30 weight percent poly(vinyl pyrrolidone) having a viscosity average molecular weight greater than 100,000 wherein individual pulp particles are stalk-free and have a length of 0.5 to 10 millimeters, a diameter of 0.1 to 50 micrometers, and an aspect ratio of greater than 100.

* * * * *